United States Patent [19]

Sugiyama

[11] Patent Number: 5,015,980

[45] Date of Patent: May 14, 1991

[54] SOLENOID SWITCH APPARATUS

[75] Inventor: Takeshi Sugiyama, Himeji, Japan

[73] Assignee: Mitsubishi Denki Kabushiki Kaisha, Tokyo, Japan

[21] Appl. No.: 501,575

[22] Filed: Mar. 30, 1990

[30] Foreign Application Priority Data

Mar. 31, 1989 [JP] Japan ..... 1-81875

[51] Int. Cl.[5] ..... H01H 63/02

[52] U.S. Cl. ..... 335/126; 335/131

[58] Field of Search ..... 335/131–132, 335/126, 231

[56] References Cited

U.S. PATENT DOCUMENTS

| | | | |
|---|---|---|---|
| 2,735,967 | 2/1956 | Lewus | 335/251 |
| 3,815,060 | 6/1974 | Turnbull | 335/131 |
| 4,142,169 | 2/1979 | Katchka et al. | 335/251 |
| 4,443,775 | 4/1984 | Fujitani et al. | 335/251 |
| 4,450,423 | 5/1984 | Morishita | 335/131 |
| 4,579,010 | 4/1986 | Colvin et al. | 335/131 |
| 4,736,178 | 4/1988 | Tanaka . | |

FOREIGN PATENT DOCUMENTS 40520 6/1987 Japan .

*Primary Examiner*—Leo P. Picard
*Assistant Examiner*—Lincoln Donovan
*Attorney, Agent, or Firm*—Sughrue, Mion, Zinn, Macpeak and Seas

[57] ABSTRACT

A solenoid switch comprising an excitation coil, a stationary iron core disposed within the excitation coil, a movable iron core slidably disposed within the excitation coil in an opposing relationship with respect to the stationary iron core, and a compression spring disposed between the stationary and movable iron cores. The solenoid switch further comprises an actuator rod slidably extending through the stationary iron core, a spring for biasing the actuator rod to have one end project from the stationary iron core toward the movable iron core, a contact assembly having a movable contact mounted on the actuator rod and a stationary contact, the contact assembly operating in accordance with the movement of the actuator rod, and a magnetic reluctance element for reducing an amount of magnetic flux passing through the movable iron core and the stationary iron core through the actuating rod. The magnetic reluctance element may be a recess 21, 22 formed in either one of the actuator rod and the movable iron core for defining an air gap therebetween.

6 Claims, 2 Drawing Sheets

SOLENOID SWITCH APPARATUSBACKGROUND OF THE INVENTION

This invention relates to a solenoid switch and, more particularly, to a solenoid switch suitable for use in a starter apparatus for a vehicular engine.

FIG. 1 illustrates one example of a solenoid switch apparatus 1 disclosed in Japanese Utility Model Publication No. 62-40520, which is used for actuating a shift lever for sliding a starter pinion and energizing a d.c. motor of an engine starter.

The illustrated solenoid switch apparatus 1 comprises a cylindrical casing 2 having an end wall 2*a*, in which an excitation coil 3 wound on a tubular coil bobbin 4 is disposed. Within the bobbin 4, a stationary iron core 5 and a plunger 6 which is a movable iron core 6 are disposed in an opposing relationship. The stationary iron core 5 has integrally formed thereon a radially outwardly extending flange 5*a* which fits on an end surface of the bobbin 4, and a cup-shaped cap member 7 is securely attached to the flange 5*a* at its open end. It is seen that a rubber packing 8 is disposed between the open end of the cap member 7 and the flange 5*a* to seal therebetween to prevent any ingress of moisture into the interior of the cap member 7.

The stationary iron core 5 has a central bore extending therethrough, within which an actutator rod 9 is slidably inserted so that one end of the actuator rod 9 projects by a predetermined distance from the stationary iron core 5 toward the movable core 6 and that the other end of the actuator rod 9 has slidably mounted thereon a movable contact 10 within the cup-shaped cap member 7. It is seen that a pair of stationary contacts 11*a* and 11*b* are mounted to and extend through the cap member 7 for external connection and for engagement with the movable contact 10.

A compression return spring 12 is disposed between the stationary iron core 5 and the movable contact 6, a compression spring 13 is disposed between the actuator rod 9 and the cap member 7 for biasing the actuator rod 9 together with the movable contact 10 to its contact open position, and a compression spring 15 is disposed between the actuator rod 9 and the movable contact 10. The movable iron core 6 has an outwardly projecting end which has an engagement hole 14 for engagment with a shift lever (not shown) of the starter apparatus.

In the above-described conventional solenoid switch apparatus 1, when it is desired to turn on the solenoid switch apparatus 1, the excitation coil 3 is energized to generate a magentic flux passing through the stationary core 5 and the actuator rod 9 as well as through the movable iron core 6 and through the casing 2. This causes the movable iron core 6 to be magnetically attracted by and moved toward the stationary iron core 5 against the spring action of the return spring 12. During this movement of the movable iron core 6, the end face of the movable iron core 6 abuts against the end face of the projecting end of the actuator rod 9, whereby the projecting end of the actuator rod 9 is pushed by the movable iron core 6 against the spring actions of the springs 12 and 13 until the end face of the actuator 9 becomes flush with the end surface of the stationary iron core 5. This causes the movable contact 10 elastically supported on the actuator rod 9 to be moved into the contact closed position in which the movable contact 10 is in electrical contact with the stationary contacts 11*a* and 11*b* under the action of the compression spring 15.

However, as soon as the movable iron core 6 abuts against the actuator rod 9, the magnetic flux concentrates onto and flows through a magnetic path from the actuator rod 9 to the movable iron core 6, which now has a very low magnetic resistance because of no air gap between the two components. Therefore, the amount of the magnetic flux which flows directly between the stationary iron core 5 and the movable iron core 6 is significantly reduced, whereby the effective magnetic attractive force between the stationary and the movable iron cores 5 and 6 is greatly reduced. However, it is necessary that this reduced attractive force is sufficiently strong to overcome the spring actions of the compression springs 12, 13 and 15 to bring the contacts 10 and 11 into their closed position. Therefore, in order to properly operate the solenoid switch, the electric power (voltage) to be supplied to the solenoid switch 1 must be made relatively high, resulting in poor switch characteristics.

Moreover, since the magnetic circuit composed of the casing 2, the stationary iron core 5, the actuator rod 9 and the movable iron core 6 is repeatedly magnetized during the operation of the solenoid switch apparatus, the magnetic flux often remains in the magnetic circuit even after the excitation coil 3 is deenergized. This causes the movable iron core 6 to magnetically stick to the actuator rod 9, maintaining the movable contact 10 in the contact closed position. While this phenomenon can be counter-measured by using a strong return spring 12, the increase of the spring force necessitates increase of the operating voltage or a larger excitation coil.

SUMMARY OF THE INVENTION

Accordingly, one object of the present invention is to provide a solenoid switch apparatus free from the above-discussed problems of the conventional solenoid switch apparatus.

Another object of the present invention is to provide a solenoid switch apparatus simple in structure and smooth in operation.

Another object of the present invention is to provide a solenoid switch apparatus which is compact.

Still another object of the present invention is to provide a solenoid switch apparatus which is reliable.

With the above objects in view, the solenoid switch apparatus of the present invention comprises an excitation coil, a stationary iron core disposed within the excitation coil, a movable iron core slidably disposed within the excitation coil in an opposing relationship with respect to the stationary iron core, and a compression spring disposed between the stationary and movable iron cores. The solenoid switch further comprises an actuator rod slidably extending through the stationary iron core, spring means for biasing the actuator rod to have one end project from the stationary iron core toward the movable iron core, and a contact assembly having a movable contact mounted on the actuator rod and a stationary contact, the contact assembly operating in accordance with the movement of the actuator rod. The solenoid switch apparatus further comprises a magnetic reluctance element for reducing an amount of magnetic flux flowing between the movable iron core and the actuator rod. The reluctance element may be a recess formed in at least one of the actuator rod or the movable iron core defining an air gap therebetween.

BRIEF DESCRIPTION OF THE DRAWINGS

The present inventions will become more readily apparent from the following detailed description of the preferred embodiments of the present invention taken in conjunction with the accompanying drawings, in which:

FIG. 2 illustrates a solenoid switch apparatus 20 which is one embodiment of the present invention. The solenoid switch apparatus 20 has a basic structure similar to that of the conventional solenoid switch apparatus 1 illustrated in FIG. 1, so that identical or corresponding components are designated by the same reference numerals.

Figure 1:
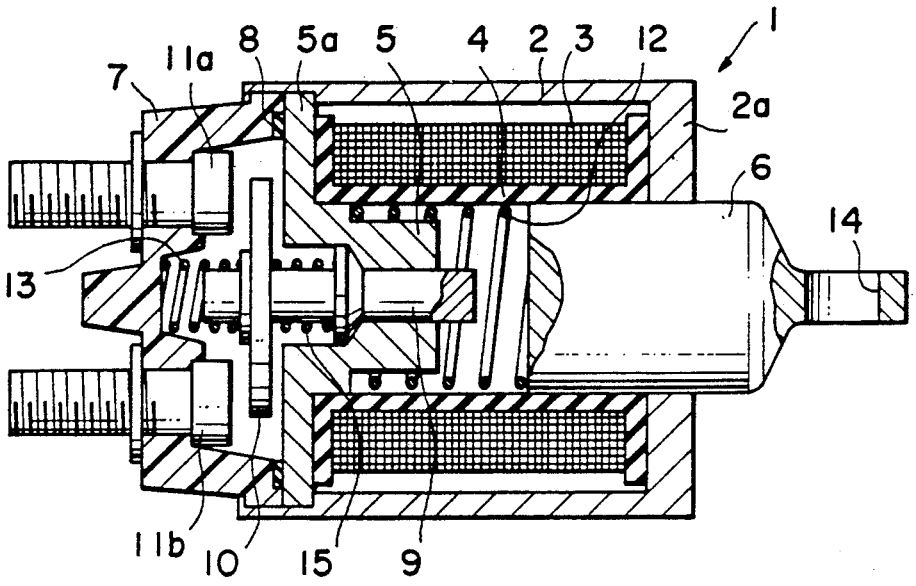
FIG. 1 PRIOR ART
FIG. 1 is a sectional side view illustrating the conventional solenoid switch apparatus.

More particularly, the solenoid switch apparatus 20 comprises a substantially cup-shaped casing 2 having an annular end wall 2*a* and an excitation coil 3 wound on a tubular coil bobbin 4 disposed within the casing 2. The open end of the casing 2 is closed by a stationary iron core 5 which has a flange 5*a* securely attached to the casing 2 and cylindrical portion 5*b* extending into the coil bobbin 4 to provide a magnetic pole face 5*c* at a predetermined location. The cylindrical portion 5*b* of the stationary iron core has a central bore 5*d* for receiving therein an actuator rod 9 which will be described later. The solenoid switch apparatus 20 also comprises a plunger or a movable iron core 6 slidably disposed within the coil bobbin 4 in an opposing relationship relative to the cylindrical portion 5*b* of the stationary core 5. The movable iron core 6 has a magnetic pole face 6*a* at the inner end and a connection end 6*b* provided with a hook 14 for connecting to a starter shift lever (not shown). A compression spring 12 is disposed between the stationary iron core 5 and the movable iron core 6 to bias the latter in the illustrated position in which the movable iron core 6 is remote from the stationary iron core 5.

The solenoid switch apparatus 20 also comprises a substantially cup-shaped cap member 7 securely attached at its open end to the flange 5*a* of the stationary iron core 5 and the casing 2. It is seen that a rubber packing 8 is disposed between the open end of the cap member 7 and the flange 5*a* to seal therebetween against ingress of moisture into the interior of the cap member 7. The cap member 7 is made of an electrically insulating material and has securely mounted thereon a pair of threaded terminals 11 having contact elements 11*a* and 11*b* at their inner ends.

Figure 2:
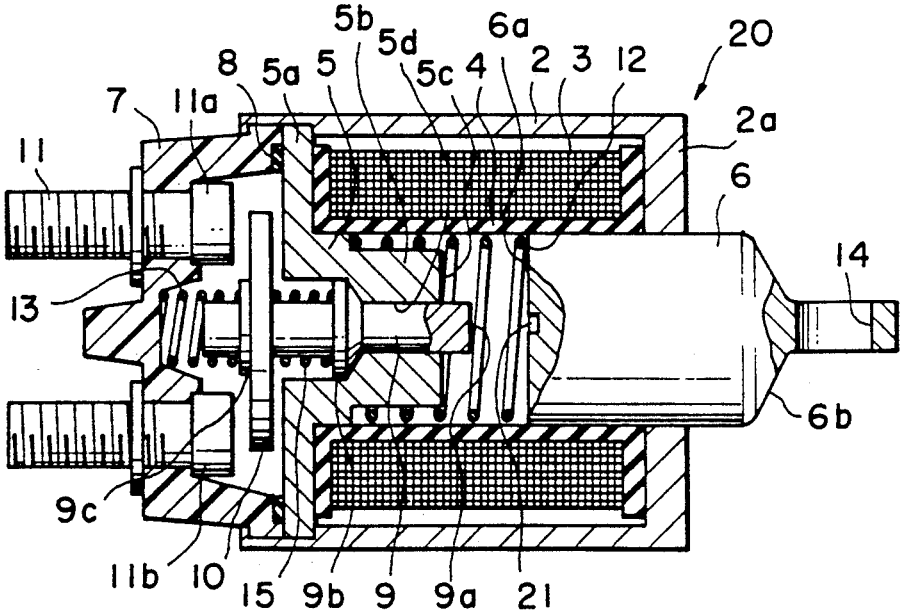
FIG. 2 is a sectional side view illustrating one embodiment of a solenoid switch apparatus of the present invention.

Slidably inserted into the central bore 5*d* of the stationary iron core 5 is an actuator rod 9 which is axially slidable between a contact opened position illustrated in FIG. 2 and a contact closed position in which contact elements 11*a* and 11*b* contact movable contact 10. The actuator rod 9 has a magnetic pole face 9*a* on one end, a first flange 9*b* which limits the amount of projection of the magnetic pole face 9*a* from the magnetic pole face 5*c* of the stationary iron core 5, and a second flange 9*c* near its rear end. A compression spring 13 is disposed between the cap member 7 and the second flange 9*c* to urge the actuator rod 9 against the stationary iron core 5. The actuator rod 9 also comprises a movable contact 10 slidably mounted on the rod 9 between the first and second flanges 9*b* and 9*c* and urged against the second flange 9*c* by a compression spring 15 disposed between the first flange 9*b* and the movable contact 10 for generating a contact pressure between the movable and stationary contact elements 10, 11*a* and 11*b* when they are brought into contact.

According to the present invention, the movable iron core 6 has formed in its magentic pole face 6*a* a magnetic reluctance element 21 for reducing the amount of magnetic flux passing through magnetic pole face 6*a* of the movable iron core 6 and the magnetic pole face 9*a* of the actuator rod 9. The magnetic reluctance element 21 in the illustrated embodiment is a partial air gap defined between the pole face 6*a* of the movable iron core 6 and the magnetic pole face 9*a* of the actuator rod 9 by a relatively small recess 21.

When the excitation coil 3 is energized, a magnetic flux passing through a magnetic circuit composed of the stationary core 5 and the actuator rod 9 as well as through the movable iron core 6 and through the casing 2 is generated. Then, the movable iron core 6 is magnetically attracted and moved toward the stationary iron core 5 against the spring aciton of the return spring 12. During this movement of the movable iron core 6, the magnetic pole face 6*a* of the movable iron core 6 first abuts against the magnetic pole face 9*a* of the actuator rod 9.

However, since the recess 21 is provided in the magnetic pole face 6*a* of the movable iron core 6, it can be considered that a magnetic reluctance in the form of an air gap is inserted into the magnetic circuit at the interface between the actuator rod 9 and the movable iron core 6. Therefore, only a relatively small limited portion of the magnetic flux is allowed to pass through the magnetic pole face 9*a* of the actuator rod 9, and the remaining portion of the magnetic flux, which is still strong enough to further attract the movable iron core 6 toward the stationary iron core 5 against the springs 12 and 13, acts between the movable iron core 6 and the stationary iron core 5 until the magnetic pole face 9*a* of the actuator rod 9 becomes flush with the magnetic pole face 5*c* of the stationary iron core 5. This causes the movable contact 10 elastically supported on the actuator rod 9 to be moved into the contact closed position in which the movable contact 10 is in electrical contact with the stationary contacts 11*a* and 11*b* under the action of the compression spring 15.

Thus, even when the movable iron core 6 is brought into contact with the actuator rod 9, the disadvantageous concentration of the magnetic flux onto the magnetic path defined through the actuator rod 9 which has been experienced in the conventional design illustrated in FIG. 1 does not occur because a magnetic reluctance element in the form of the recess 21 is inserted. Therefore, the electric power (voltage) to be supplied to the solenoid switch 1 does not need to be made relatively high, resulting in improved switch characteristics and a proper operation of the solenoid switch apparatus 20.

Also, even when the magnetic circuit composed of the casing 2, the stationary iron core 5, the actuator rod 9 and the movable iron core 6 is repeatedly magnetized during the operation of the solenoid switch apparatus 20, the magnetic flux which may remain in the magnetic circuit even after the excitation coil 3 is deenergized is relatively weak. Therefore, the movable iron core 6 is prevented from magnetically sticking to the actuator rod 9, so that the return spring 12 can be made relatively weak, allowing the operating voltage to be made low or a smaller excitation coil to be used. Thus, the solenoid switch apparatus 20 can be made smooth and reliable in operation.

Figure 3:
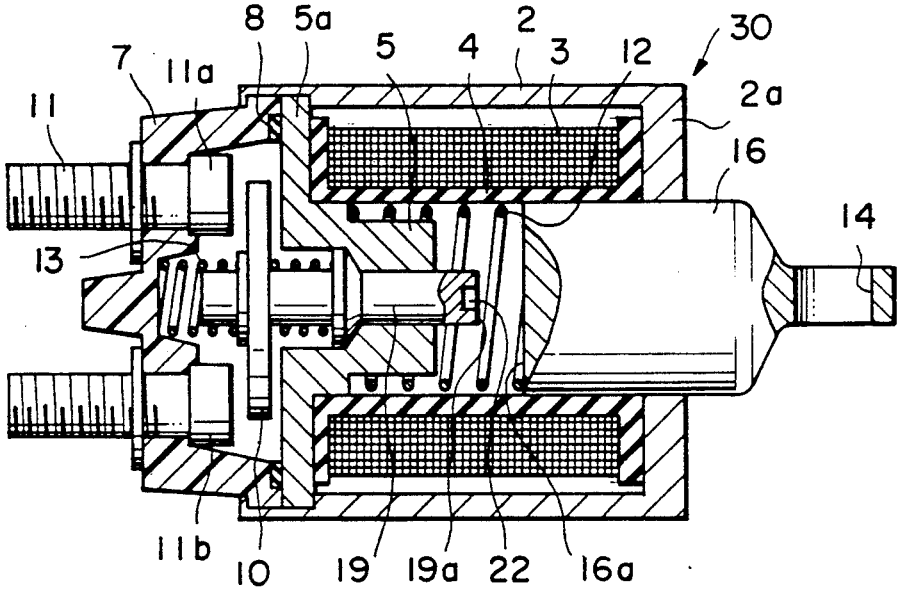
FIG. 3 is a sectional side view illustrating another embodiment of a solenoid switch apparatus of the present invention. DESCRIPTION OF THE PREFERRED EMBODIMENTS

FIG. 3 illustrates another embodiment of the present invention in which a solenoid switch apparatus 30 comprises an actuator rod 19 having a magnetic reluctance element 22 in the form of a recess formed in a magnetic pole face 19*a* and a movable iron core 16 having a magnetic pole face 16*a* in which no recess is formed. In other respects, the solenoid switch apparatus 30 is the same as the solenoid switch apparatus 20 of the previous embodiment described and illustrated in conjunction with FIG. 2. The operation and the function of the solenoid switch apparatus 30 of this embodiment is also the same as that of the solenoid switch apparatus 20 shown in FIG. 2.

Also, the recesses 21 and 22 may be filled with a suitable non-magnetic material. Alternatively, each of the movable iron core and the actuator rod may be provided with a recess for increasing the magnetic reluctance, if desired.

What is claimed is:

1. A solenoid switch, comprising:

an excitation coil (3);

a stationary iron core (5) disposed within said excitation coil;

a movable iron core (6;16) slidably disposed within said excitation coil in an opposing relationship with respect to said stationary iron core;

a compression spring (12) disposed between said stationary and movable iron cores;

an actuator rod (9; 19) slidably extending through said stationary iron core;

spring means (13) for biasing said actuator rod to have a planar inner end thereof projecting from said stationary iron core toward a planar inner end of said movable iron core;

a contact assembly having a movable contact (10) mounted on said actuator rod and stationary contact means (11*a*, 11*b*), said contact assembly operating in accordance with the movement of said actuator rod; and magnetic reluctance modification means (21; 22) defined in the inner end of the actuator rod or the movable iron core for reducing an amount of magnetic flux passing between said movable iron core and said stationary iron core via said actuating rod upon engagement between the inner ends of the actuator rod and the movable iron core, and for attendantly enhancing the amount of magnetic flux passing directly between the movable iron core and the stationary iron core.

2. A solenoid switch as claimed in claim 1, wherein said magnetic reluctance modified means comprises an air gap defined between said movable iron core and said actuator rod.

3. A solenoid switch as claimed in claim 2, wherein said air gap is filled with a non-magnetic material.

4. A solenoid switch as claimed in claim 1, wherein said magnetic reluctance modification means comprises a recess disposed in the inner end of said actuating rod.

5. A solenoid switch as claimed in claim 1, wherein said magnetic reluctance modification means comprises a recess disposed in the inner end of said movable iron core.

6. A solenoid switch as claimed in claim 4, wherein said magnetic reluctance modification means further comprises a recess disposed in the inner end of said movable iron core.

* * * * *